US011131533B1

(12) United States Patent
Albrecht

(10) Patent No.: US 11,131,533 B1
(45) Date of Patent: Sep. 28, 2021

(54) SHOCK RESISTANT MOUNTING STRUCTURES FOR FUZE SYSTEMS

(71) Applicant: The United States of America, as represented by the Secretary of the Navy, Arlington, VA (US)

(72) Inventor: Nicholas H. Albrecht, Ridgecrest, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 29 days.

(21) Appl. No.: 16/737,214

(22) Filed: Jan. 8, 2020

(51) Int. Cl.
*F42C 19/04* (2006.01)
*F42C 19/02* (2006.01)
*F42B 39/24* (2006.01)

(52) U.S. Cl.
CPC ..... *F42C 19/04* (2013.01); *F42B 39/24* (2013.01); *F42C 19/02* (2013.01)

(58) Field of Classification Search
CPC ..... F42C 19/02; F42C 19/04; F42B 39/24
USPC ..... 102/331, 332, 333, 202, 275.9, 275.11, 102/275.12
See application file for complete search history.

(56) References Cited

U.S. PATENT DOCUMENTS 5,327,835 A * 7/1994 Adams ..... F42D 1/043 102/275.11
5,492,366 A * 2/1996 Osborne ..... B60R 21/2644 102/202.5
5,799,974 A * 9/1998 Honda ..... B60R 21/203 280/728.2
6,283,505 B1 * 9/2001 Saso ..... B60R 21/2644 280/736
7,971,533 B1 * 7/2011 Berlin ..... F42C 19/02 102/275.9
2016/0169640 A1 * 6/2016 Schwuchow ..... B23P 19/00 102/530

* cited by examiner

*Primary Examiner* — Joshua E Freeman
(74) *Attorney, Agent, or Firm* — Naval Air Warfare Center; Jimmy M. Sauz

(57) ABSTRACT

Shock resistant mounting structures for fuze systems. The shock resistant mounting structures may comprise: a shock resistant base cap and a shock resistant washer. The shock resistant base cap may comprise a circular cap housing and a plurality of first cripple studs disposed within the circular cap housing. The circular cap housing may be configured to engage a flange end of a fuze and may be adapted to snugly fit within a fuze well. The shock resistant washer may comprise a ring-shaped housing and one or more second cripple studs radially disposed within the ring-shaped housing. The ring-shaped housing may have a center opening adapted to engage a fuze body. When installed, the shock resistant base cap and shock resistant washer may be disposed within the fuze well and may minimize or divert shock loading energy from entering a fuze.

1 Claim, 3 Drawing Sheets

SHOCK RESISTANT MOUNTING STRUCTURES FOR FUZE SYSTEMS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF USE

The present disclosure relates generally to shock resistant structures configured to absorb, minimize, or divert shock energy for fuze survivability.

BACKGROUND

When performing shock testing or within a tactical environment, a device may be subject to sudden and extreme amounts of acceleration or deceleration. This helps determine to what degree items can physically withstand relatively infrequent forces or mechanical shocks and vibrations. During pyroshock testing or warhead penetration testing, for example, extreme shock waves may travel through various structures and advance into the housings of the electronics (e.g., fuze). These shock waves may mechanically break and damage the sensitive electronics, often impairing or disabling the warhead and disrupting mission critical events. In this regard, there is a need for a device or mechanism that absorbs, diverts, or minimizes extreme shock loading energy traveling towards critical electronic components.

SUMMARY OF ILLUSTRATIVE EMBODIMENTS

To minimize the limitations in the related art and other limitations that will become apparent upon reading and understanding the present specification, the following discloses embodiments of new and useful shock resistant mounting structures for fuze systems.

One embodiment may be a shock resistant washer, comprising: a ring-shaped housing having a center opening adapted to engage a fuze body, such that the ring-shaped housing may surround and snugly fit at least a portion of the fuze body; and one or more cripple studs radially disposed within the ring-shaped housing; wherein the one or more cripple studs may extend between opposing sides of the ring-shaped housing. The ring-shaped housing may be filled with a urethane polymer. Each of the one or more cripple studs may have an I-beam cross section with a web portion having a maximum thickness of 0.25 inches. Each of the one or more cripple studs may comprise at least one cantilever portion extending from the web portion; wherein the one or more cripple studs may be oriented in spaced parallel relation to each other with the at least one cantilever portion in opposing relation. Each of the one or more cripple studs may have a cross-shaped beam cross section. The ring-shaped housing and the one or more cripple studs may be constructed of a metal.

Another embodiment may be a shock resistant base cap, comprising: a circular cap housing having a receptacle configured to engage a flange end of a fuze, the circular cap housing being adapted to snugly fit within a fuze well, such that the circular cap housing may be disposed between the flange end of the fuze and the faze well; and a plurality of cripple studs disposed within the circular cap housing; wherein the plurality of cripple studs may extend between first and second sides of the circular cap housing. The circular cap housing may be filled with a urethane polymer. Each of the plurality of cripple studs may have an I-beam cross section and a web portion having a maximum thickness than 0.25 inches. Each of the plurality of cripple studs may comprise at least one cantilever portion extending from the web portion; wherein the plurality of cripple studs may be oriented in spaced parallel relation to each other with the at least one cantilever portion in opposing relation. Each of the plurality of cripple studs may have a cross-shaped beam cross section. The circular cap housing and the plurality of cripple studs may be constructed of a metal.

Another embodiment may be a shock resistant base cap and shock resistant washer combination, comprising: a shock resistant base cap and a shock resistant washer. The shock resistant base cap may comprise: a circular cap housing having a receptacle configured to engage a flange end of a fuze, the circular cap housing being adapted to snugly fit within a fuze well, such that the circular cap housing may be disposed between the flange end of the fuze and the fuze well; and a plurality of first cripple studs disposed within the circular cap housing. The shock resistant washer may comprise: a ring-shaped housing having a center opening adapted to engage a fuze body, the ring-shaped housing having an outer diameter less than a diameter of the receptacle of the circular cap housing, such that when the fuze body is snugly fit within the center opening of the ring-shaped housing, the ring-shaped housing may fit within the receptacle of the circular cap housing, the fuze well, and the flange end of the fuze; and one or more second cripple studs radially disposed within the ring-shaped housing. The flange end of the fuze may be disposed between the shock resistant base cap and the shock resistant washer when the shock resistant washer and the shock resistant base cap are engaged with the flange end of the fuze and installed within the fuze well. The circular cap housing may be filled with a urethane polymer. The ring-shaped housing may be filled with a urethane polymer. The plurality of first cripple studs may extend between opposing sides within the circular cap housing and may be oriented in spaced parallel relation to each other. Each of the plurality of first cripple studs may have an offset beam cross section extending between opposing sides of the circular cap housing and may be oriented in a direction towards the fuze. Each of the one or more second cripple studs may have a cross-shaped beam cross section and extends within opposing sides of the washer housing. The shock resistant base cap and the shock resistant washer may be constructed of a metal. The shock resistant base cap and shock resistant washer combination may further comprise a retaining ring adapted to snugly fit within the fuze well when the shock resistant base cap, the shock resistant washer, and the fuze are installed within the fuze well.

It is an object to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are illustrative embodiments. They do not illustrate all embodiments. They do not set forth all embodiments. Other embodiments may be used in addition or instead. Details, which may be apparent or unnecessary, may be omitted to save space or for more effective illustration. Some embodiments may be practiced with additional components or steps and/or without all of the components or steps, which are illustrated. When the same numeral appears in different drawings, it is intended to refer to the same or like components or steps.

DETAILED DESCRIPTION OF ILLUSTRATIVE EMBODIMENTS

Figure 1:
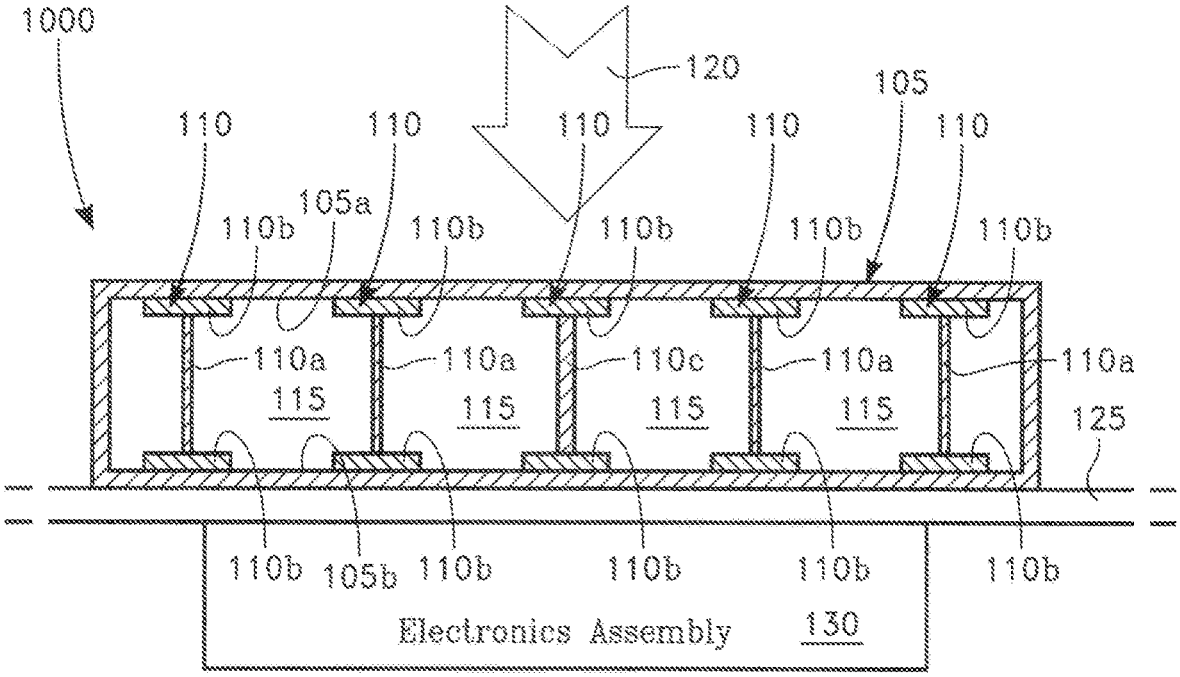
FIG. 1 is an illustration of a cross section view of one embodiment of a shock resistant mounting structure for fuze systems.

In the following detailed description, numerous specific details are set forth in order to provide a thorough understanding of various aspects of one or more embodiments of the shock resistant mounting structures for fuze systems. However, these embodiments may be practiced without some or all of these specific details. In other instances, well-known methods, procedures, and/or components have not been described in detail so as not to unnecessarily obscure the aspects of these embodiments.

Before the embodiments are disclosed and described, it is to be understood that these embodiments are not limited to the particular structures, process steps, or materials disclosed herein, but is extended to equivalents thereof as would be recognized by those ordinarily skilled in the relevant arts. It should also be understood that the terminology used herein is used for the purpose of describing particular embodiments only and is not intended to be limiting.

Reference throughout this specification to "one embodiment," "an embodiment," or "another embodiment" may refer to a particular feature, structure, or characteristic described in connection with the embodiment of the present disclosure. Thus, appearances of the phrases "in one embodiment" or "in an embodiment" in various places throughout this specification may not necessarily refer to the same embodiment.

Furthermore, the described features, structures, or characteristics may be combined in any suitable manner in various embodiments. In the following description, numerous specific details are provided, such as examples of materials, fasteners, sizes, lengths, widths, shapes, etc . . . to provide a thorough understanding of the embodiments. One skilled in the relevant art will recognize, however, that the scope of protection can be practiced without one or more of the specific details, or with other methods, components, materials, etc. . . . In other instances, well-known structures, materials, or operations are generally not shown or described in detail to avoid obscuring aspects of the disclosure.

Definitions

In the following description, certain terminology is used to describe certain features of the embodiments of the shock resistant mounting structures for fuze systems. For example, as used herein, unless otherwise specified, the term "substantially" refers to the complete, or nearly complete, extent or degree of an action, characteristic, property, state, structure, item, or result. As an arbitrary example, an object that is "substantially" surrounded would mean that the object is either completely surrounded or nearly completely surrounded. The exact allowable degree of deviation from absolute completeness may in some cases depend on the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "approximately" may refer to a range of values of ±10% of a specific value.

As used herein, the term "near" refers to a region within close proximity of an intended point, position, or target. The term "near" may also refer to being at the intended point, position, or target.

As used herein the term "somewhat" refers to a range of values of ±50% of a specific value.

As used herein, the term "about" is used to provide flexibility to a numerical range endpoint by providing that a given value may be "a little above" or "a little below" the endpoint. In some cases, the term "about" is to include a range of not more than about two inches of deviation.

By way of illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5.

This same principle applies to ranges reciting only one numerical value and should apply regardless of the breadth of the range or the characteristics being described.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

This same principle applies to ranges reciting only one numerical value and should apply regardless of the breadth of the range or the characteristics being described.

As used herein in this disclosure, the singular forms "a" and "the" may include plural referents, unless the context clearly dictates otherwise.

The present disclosure relates generally to mounting structures that minimize, divert, or eliminate extreme shocks. In general, when sensitive electronics are subject to sudden force or impact, shock energy may travel and physically damage the electronics. Shock testing may help prevent or mitigate such damage by subjecting a test device to sudden and extreme amounts of acceleration or deceleration and determining to what degree items can physically withstand relatively infrequent forces or mechanical vibrations. During pyroshock testing or warhead penetration testing, for example, extreme shock waves may travel through various mounting structures and advance into a fuze system. These shock waves may mechanically break the electronics, often impairing or disabling the warhead and disrupting mission critical events.

Embodiments of the shock resistant mounting structure for fuze systems disclosed herein solve this problem by interfacing the fuze system with a plurality of cripple studs that divert or physically deform when subject to extreme shocks or vibrations. For example, one embodiment of the shock resistant mounting structure may be a shock resistant base cap, comprising a circular cap housing configured to engage and disengage a flange end of a fuze. The circular cap housing may comprise a plurality of cripple studs disposed within the circular cap housing, and the cripple studs may deform when experiencing extreme shock or vibrations.

In another embodiment, the shock resistant mounting structure may be a shock resistant base cap and shock resistant washer combination adapted to interface a flange end of a fuze. The shock resistant base cap may engage a flange end of the fuze and may comprise cripple studs disposed therein. The shock resistant washer may engage with the fuze body and may likewise comprise cripple studs to mechanically deform upon receiving extreme shock. In this manner, both the shock resistant base cap and shock resistant washer may absorb or divert extreme shock loading energy from damaging critical electronic components.

In the accompany drawings, like reference numbers indicate like elements. Reference characters 1000, 2000, 3000 depict various embodiments of the shock resistant mounting structures for fuze systems.

FIG. 1 is an illustration of a cross section view of one embodiment of a shock resistant mounting structure for fuze systems. The shock resistant mounting structure 1000 may be adapted to interface sensitive electronics by mounting the shock resistant mounting structure 1000 onto an electronics mounting surface 125 directly onto a pathway between a potential shock energy 120 and electronics assembly 130. This may allow shock energy 120 traveling through the housing 105 to be absorbed or dissipated upon arrival of the shock resistant mounting structure 1000.

As shown in FIG. 1, one embodiment of the shock resistant mounting structure 1000 may comprise a housing 105 and a plurality of cripple studs 110. The housing 105 may be a rigid casing that houses and encloses the cripple studs 110. The cripple studs 110 may be special-purpose structural members that are physically coupled to and between at least two interior sides of the housing 105. In other embodiments, the cripple studs 110 may be integrated with the shock resistant housing 105 as a single or unitary piece. Importantly, the cripple studs 110 may be adapted to physically deform upon receiving shock energy 120.

Embodiments of the cripple studs 110 may be manufactured in various shapes and may comprise at least two flange ends 1106 coupled to the inner opposing sides 105*a*, 105*b* of the housing 105 and a web portion 110*a*, 110*c* that extends between the flange ends 110*b*. For example, as shown in FIG. 1, one embodiment of the cripple studs 110 may have an I-beam cross section with a web portion 110*a*, 110*c* extending between the flange ends 110*b* located at the inner opposing sides 105*a*, 1056 of the housing 105. The flange ends 1106 may also provide vertical support to the web portions 110*a*, 110*c*. Importantly, the web portions 110*a*, 110*e* preferably have a maximum thickness of 0.25 inches. This may allow the web portions 110*a* to be semi-rigid in order to deform when subject to shock energy 120, yet strong enough to withstand typical forces and stresses associated with everyday use and misuse. In other embodiments, the web portions 110*a*, 110*c* or the cripple studs 110 may have varying thicknesses, as shown in FIG. 1. For example, web portion 110*c* may have a larger thickness than web portion 110*a*. Additionally, each cripple stud 110 may be in spaced parallel relation with each other and may be oriented directly within the loading path and buckle between the electronic assembly 130 and shock energy 120. In this manner, the cripple studs 110 may deform or break at a prescribed loading condition.

The shock resistant mounting structures 1000 may be constructed of various materials. For example, in one embodiment, the shock resistant mounting structure 1000 may be constructed of a metal, Examples of such metals may include, without limitation: aluminum, titanium alloy, nickel alloy (e.g., Inconel®), and maraging steel. In another embodiment, the shock resistant mounting structure 1000 may be cast or additively manufactured.

In another embodiment, the shock resistant mounting structure 1000 may also be filled with an insulating liquid compound such as urethane polymer 115. Specifically, urethane polymer 115 may be used to fill the housing 105 to further damp shock or vibrational energy at frequencies spectra known to excite printed circuit board mounted electronic components. Preferably, an insulating liquid compound that solidifies is used in order to permanently protect the cripple studs 110 and assembly. The urethane polymer 105 may provide shielding or heat dissipating functions in addition to preventing or mitigation extreme shock. Other embodiments that may be used to also fill the shock resistant mounting structure 1000 may include, without limitation, epoxy potting compounds, urethane potting compounds, and silicone potting compounds.

Figure 2:
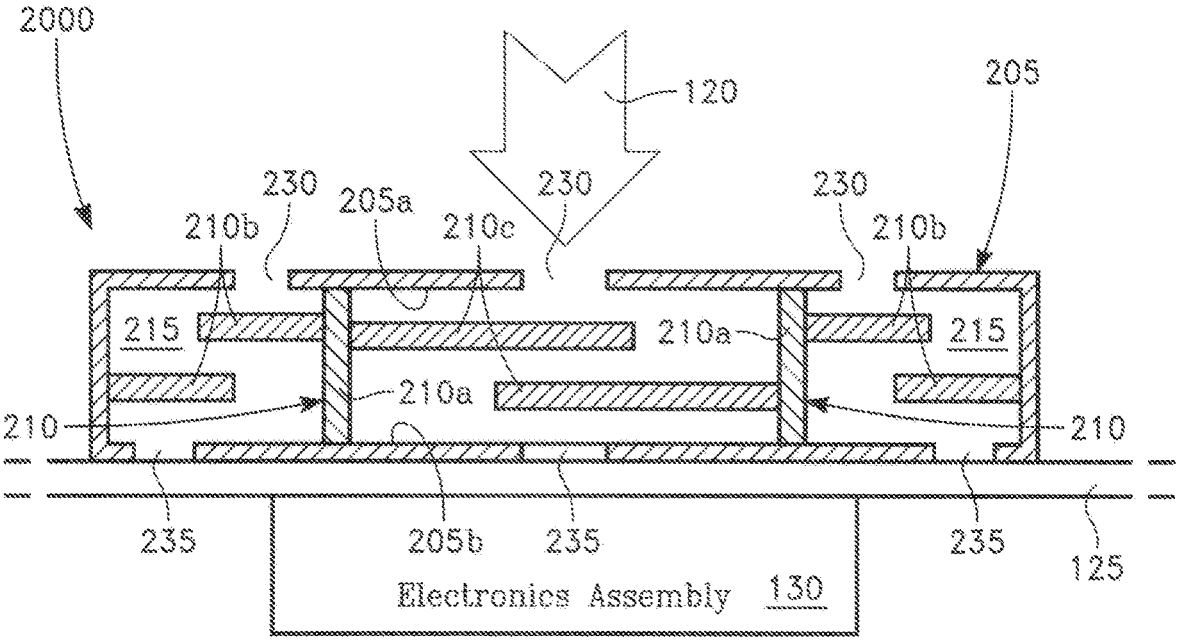
FIG. 2 is an illustration of a cross section view of another embodiment of the shock resistant mounting structure for faze systems.

FIG. 2 is an illustration of a cross section view of another embodiment of the shock resistant mounting structure. As shown in FIG. 2, another embodiment of the shock resistant mounting structure 2000 may comprise a housing 205 and a plurality of cripple studs 210 disposed within the housing 205. Like the previous embodiment, the housing 205 may be a rigid casing that houses and encloses the cripple studs 210. The cripple studs 210 may be special-purpose structural members coupled to and disposed between at least two interior sides of the housing 205. The cripple studs 210 are also preferably adapted to physically deform upon receipt of high-amplitude shock energy 120 or forces.

FIG. 2 also shows that another embodiment of the shock resistant mounting structure 2000 may comprise a housing 205 having fill ports 230 and vacuum ports 235. In particular, the housing 205 may having a first side 205*a* with one or more fill ports 230 and a second side 205*b* with one or more vacuum ports 235. The fill ports 230 are preferably openings or apertures that allow liquid to enter into the shock resistant mounting structure 2000. The vacuum ports 235 are preferably openings or apertures used for applying negative air pressure to remove any excess gas or liquid. The fill ports 230 and vacuum ports 235 are preferably in fluid communication with each other such that filling the shock resistant mounting structure 2000 with the insulating liquid compound (e.g., urethane polymer) via the fill port 230 may be performed without the inclusion of voids.

Unlike the previous embodiment, FIG. 2 also shows that another embodiment of the cripple studs 210 may lack flange ends but may comprise a web portion 210*a* and one or more cantilever portions 210*b* extending from the web portion 210*a*. As shown in FIG. 2, the cripple studs 210 may be oriented in spaced parallel relation to each other, and the cantilever portions 210 may be disposed in opposing relation 210*b* to each other. In this manner, the urethane polymer may travel thoroughly in between the web portions 210*a* and cantilever portions 210*b* of the cripple studs 210. Like the previous embodiment shown in FIG. 1, each web portion 210*a* preferably has a thickness of no more than 0.25 inches. As noted above, the web portions 210*a* may be semi-rigid for deforming or absorbing shock energy 120 or break at a prescribed loading condition.

Figure 3:
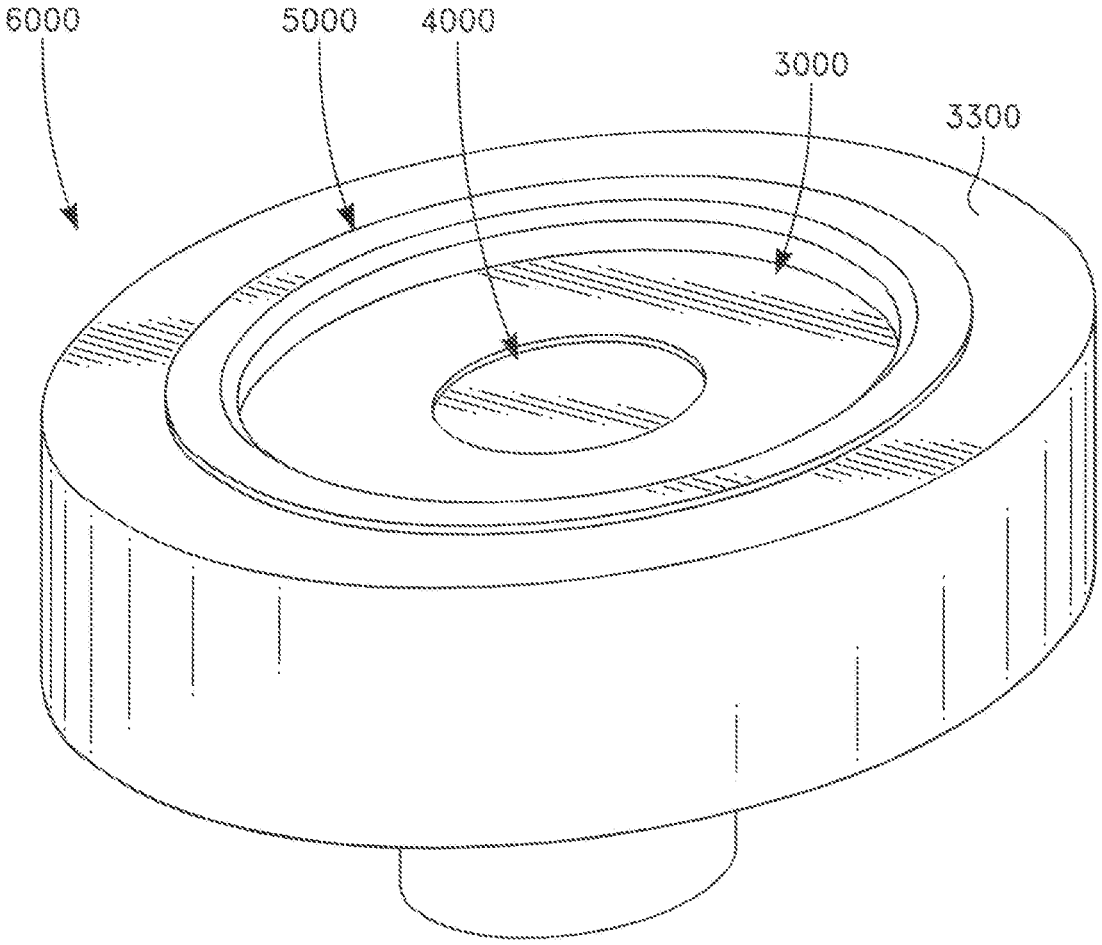
FIG. 3 is an illustration of a perspective view of a fuze assembly.

FIG. 3 is an illustration of a perspective view of a fuze assembly. As shown in FIG. 3, the fuze assembly 6000 may comprise a fuze 4000, fuze well 3300, shock resistant mounting structure, and retaining ring 5000. Here, additional embodiments of the shock resistant mounting structure may be a shock resistant base cap and shock resistant washer combination 3000, comprising a shock resistant base cap 3100 and shock resistant washer 3200, as shown below in FIGS. 4A and 4B.

The fuze 4000 may be a device configured to detonate a munition's explosive material under specified conditions and may have safety and arming mechanisms that protect users from premature or accidental detonation. Importantly, the fuze 4000 may contain the electronic or mechanical elements necessary to signal or actuate the detonator and may contain a small amount of primary explosive to initiate the detonation.

The fuze well 3300 may be a physical envelope or casing for interfacing the fuze 4000, Importantly, the fuze well 3300 may be adapted to hold and secure a shock resistant base cap 3100, shock resistant washer 3200, and fuze 4000. Additional details of the shock resistant base cap 3100 and shock resistant washer 3200 are described in FIGS. 4A and 4B below.

Figure 4A:
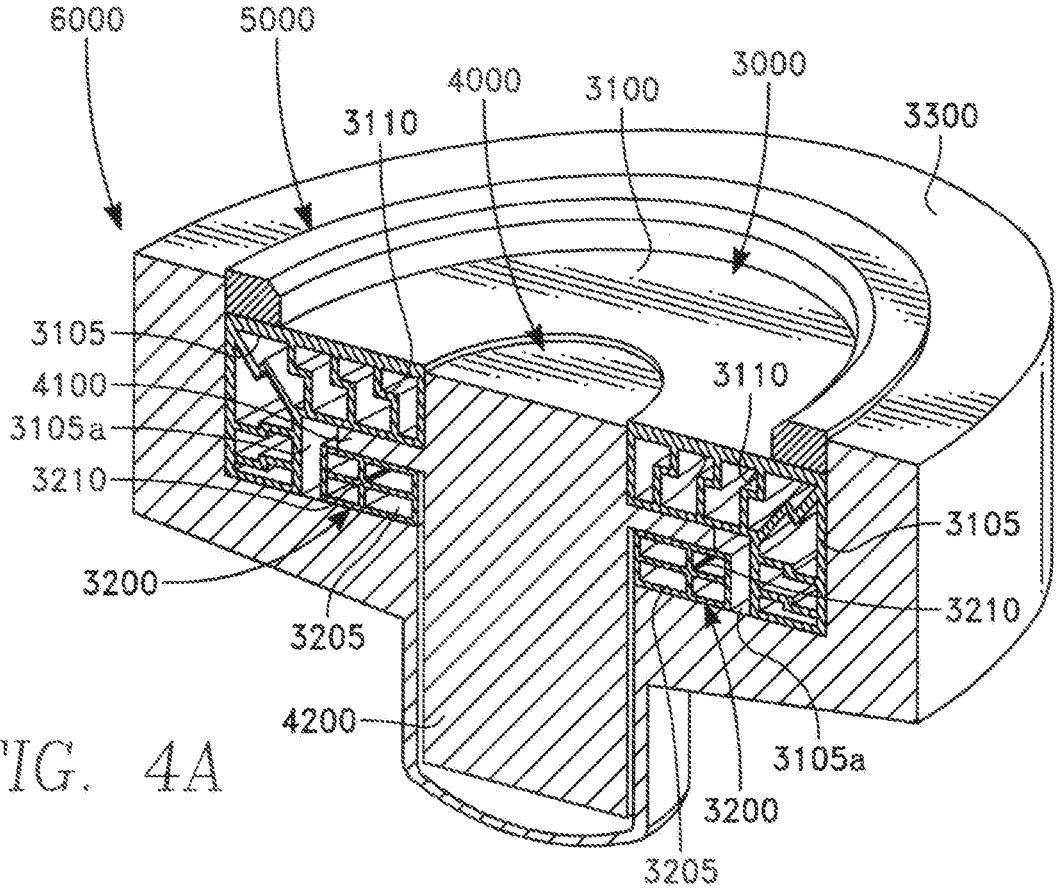
FIGS. 4A and 4B are illustrations of perspective and side elevation, cross section views, respectively, of the fuze assembly and shows additional embodiments of the shock resistant mounting structures installed thereon.
Figure 4B:
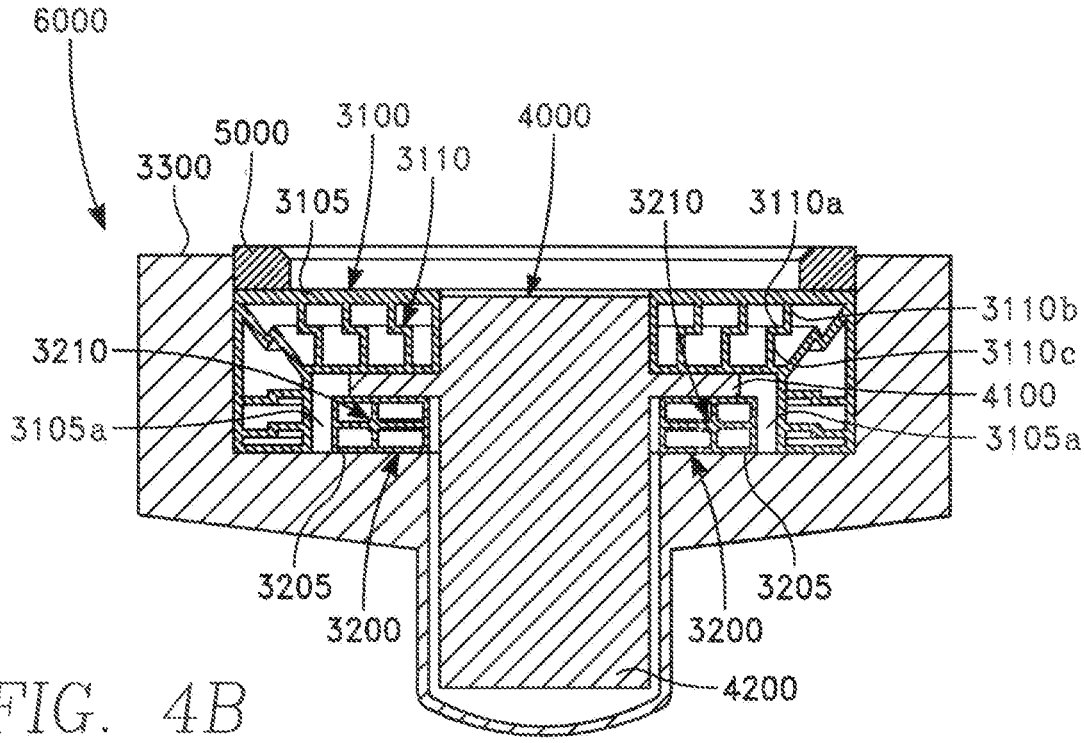

FIGS. 4A and 4B are illustrations of perspective and side elevation, cross section views, respectively, of the fuze assembly and shows additional embodiments of the shock resistant mounting structures installed thereon. Importantly, FIGS. 4A and 4B show additional embodiments of the shock resistant mounting structures as a shock resistant base cap and shock resistant washer combination 3000, comprising a shock resistant base cap 3100 and shock resistant washer 3200. The shock resistant base cap 3100 is preferably a cover or cap adapted to engage and cover a flange end 4100 of a fuze 4000 and may comprise a circular cap housing 3105 and plurality of cripple studs 3110. In order to protect the upper portion of the flange end 4100 of the fuze 4000 within the fuze well 3300, the circular cap housing 3105 may be substantially circular and have a protruding circular edge to form receptacle 3105*a*. The receptacle 3105*a* may be configured to engage a flange end 4100 of the fuze 4000, such that the flange end 4100 of the fuze 4000 may fit within the receptacle 3105*a* of the circular cap housing 3105.

Regarding the cripple studs 3110 of the shock resistant base cap 3100, the cripple studs 3110 may be adapted to absorb or deform upon receipt of shock loading energy 120. The cripple studs 3110 may be disposed within the circular cap housing 3105 and may extend between the inner, opposing sides thereon. The cripple studs 3110 may also be arranged in spaced parallel relation to each other and may be oriented in a direction extending towards the fuze 4000. In this manner, shock loading energy 120 may be first required to travel along one or more cripple studs 3110 prior to advancing towards the fuze 4000.

FIGS. 4A and 4B also show that each cripple stud 3110 may have web portions 3110*a*, 3110*b*, 3110*c* shaped with an offset beam cross section extending between opposing sides of the circular cap housing 3105. In other embodiments, however, other shapes and cross sections may be used. For example, in another embodiment, each cripple stud 110 may have an I-beam cross section, as shown in FIG. 1. While, in another embodiment, each cripple stud 210 may have at least one cantilever portion extending from the web portion, as shown in FIG. 2.

FIGS. 4A and 4B also show that the shock resistant fuze insert and shock resistant washer combination 3000 may also comprise a shock resistant washer 3200. The shock resistant washer 3200 is preferably adapted to engage the fuze body 4200 of a fuze 4000 and may be adapted to position beneath the flange end 4100 of the fuze 4000 when engaged. Thus, when coupled to the fuze body 4200 while installed within a fuze well 3300, the shock resistant washer 3200 may be disposed between the flange end 4100 of the fuze 4000 and fuze well 3300, as shown in FIGS. 4A and 4B. In exemplary embodiments, the shock resistant washer 3200 may comprise a ring-shaped housing 3205 and cripple studs 3210. The ring-shaped housing 3205 may have a center opening adapted to engage with the fuze body 4200 of a fuze 4000. The ring-shaped housing 3205 preferably has an outer diameter that is less than the diameter of the receptacle 3105*a* of the circular cap housing 3105. In this manner, the ring-shaped housing 3105 may be adapted to engage the fuze body 4200 and be disposed within the receptacle 3105*a* of the circular cap housing 3105, fuze well 3300, and flange end 4100 of the fuze 4000.

Regarding the cripple studs 3210 of the shock resistant washer 3200, the cripple studs 3210 may absorb or deform upon receipt of shock loading energy 120. The cripple studs 3210 of the shock resistant washer 3200 are preferably located within the ring-shaped housing 3205 and may be radially disposed within the ring-shaped housing 3205. This may allow shock loading energy 120 entering from outside the fuze well 3300 to first travel along the cripple studs 3210 prior to contacting the fuze 4000. Each cripple stud 3210 may also have a cross-shaped beam cross section, as shown in FIGS. 4A and 4B, and may extend within opposing sides of the ring-shaped housing 3105. In other embodiments, each cripple stud 3210 may have various shapes such as an I-beam cross section, as shown in FIG. 1, offset beam cross section, or web portion and cantilever portion combination, as shown in FIG. 2.

When installed, the flange end. 4100 of the fuze 4000 is preferably sandwiched or disposed between the shock resistant base cap 3100 and the shock resistant washer 3200. In particular, the shock resistant base cap 3100 may substantially cover the flanged end 4100 of the fuze when the shock resistant base cap 3100 is engaged with the flange end 4100 of the fuze 4000. The shock resistant washer 3200 may engaged with the fuze body 4200 of the fuze 4000. When engaged within the fuze well 3300, the shock resistant base cap and shock resistant washer combination 3000 may further comprise a retaining ring 5000 for holding and securing the shock resistant fuze base cap 3100 and shock resistant washer 3200 in place. Specifically, the retaining ring 5000 may snugly fit above the shock resistant base cap 3100 and within the fuze well 3300 when the shock resistant base cap 3100 and shock resistant washer 3200 are installed.

The shock resistant base cap 3100 and shock resistant washer 3200 are preferably constructed of a metal. Examples of such metals may include, without limitation, aluminum, titanium alloy, nickel alloy (e.g., Inconel®), and managing steel. In another embodiment, the shock resistant base cap 3100 and shock resistant washer 3200 may be cast or additively manufactured. Additionally, the shock resistant base cap 3100 and/or shock resistant washer 3200 may be filled with an insulating compound such as a urethane polymer.

The foregoing description of the embodiments of the shock resistant mounting structures for fuze systems has been presented for the purposes of illustration and description. While multiple embodiments of the shock resistant mounting structures are disclosed, other embodiments will become apparent to those skilled in the art from the above detailed description. As will be realized, these embodiments are capable of modifications in various obvious aspects, all without departing from the spirit and scope of the present disclosure. Accordingly, the detailed description is to be regarded as illustrative in nature and not restrictive.

Although embodiments of the shock resistant mounting structure are described in considerable detail, other versions are possible such as, for example, orienting and/or attaching the shock resistant base cap and/or shock resistant washer in a different fashion. Therefore, the spirit and scope of the appended claims should not be limited to the description of versions included herein.

Except as stated immediately above, nothing, which has been stated or illustrated, is intended or should be interpreted to cause a dedication of any component, step, feature, object, benefit, advantage, or equivalent to the public, regardless of whether it is or is not recited in the claims. The scope of protection is limited solely by the claims that now follow, and that scope is intended to be broad as is reasonably consistent with the language that is used in the claims. The scope of protection is also intended to be broad to encompass all structural and functional equivalents.

What is claimed as new and desired to be protected by Letters Patent is set forth in the appended claims:

1. A shock resistant base cap and shock resistant washer combination, comprising:

a shock resistant base cap, comprising:

a circular cap housing having a receptacle configured to engage a flange end of a fuze, said circular cap housing being adapted to snugly fit within a fuze well, such that said circular cap housing is adapted to be disposed between said flange end of said fuze and said fuze well; and a plurality of first cripple studs disposed within said circular cap housing;

a shock resistant washer, comprising:

a ring-shaped housing having a center opening adapted to engage a fuze body, said ring-shaped housing having an outer diameter less than a diameter of said receptacle of said circular cap housing, such that when said fuze body is snugly fit within said center opening of said ring-shaped housing, said ring-shaped housing is adapted to fit within said receptacle of said circular cap housing and said fuze well; and one or more second cripple studs radially disposed within said ring-shaped housing; and a retaining ring adapted to snugly fit within said fuze well when said shock resistant base cap, said shock resistant washer, and said fuze are installed within said fuze well;

wherein said flange end of said fuze is disposed between said shock resistant base cap and said shock resistant washer when said shock resistant washer and said shock resistant base cap are engaged with said flange end of said fuze and installed within said fuze well.

* * * * *